US010413771B1

(12) United States Patent
Del Conte

(10) Patent No.: US 10,413,771 B1
(45) Date of Patent: Sep. 17, 2019

(54) EXERCISE SYSTEMS AND METHODS

(71) Applicant: Wayne Del Conte, Mount Vernon, WA (US)

(72) Inventor: Wayne Del Conte, Mount Vernon, WA (US)

( * ) Notice: Subject to any disclaimer, the term of this patent is extended or adjusted under 35 U.S.C. 154(b) by 0 days.

(21) Appl. No.: 15/803,488

(22) Filed: Nov. 3, 2017

Related U.S. Application Data

(60) Provisional application No. 62/417,065, filed on Nov. 3, 2016.

(51) Int. Cl.

| | |
|---|---|
| ***A63B 21/05*** | (2006.01) |
| ***A63B 21/02*** | (2006.01) |
| ***A63B 21/00*** | (2006.01) |
| ***A63B 23/035*** | (2006.01) |
| ***A63B 23/025*** | (2006.01) |
| ***A63B 23/12*** | (2006.01) |
| ***A63B 23/02*** | (2006.01) |
| ***A63B 23/04*** | (2006.01) |

(52) U.S. Cl.
CPC ..... *A63B 21/05* (2013.01); *A63B 21/023* (2013.01); *A63B 21/4033* (2015.10); *A63B 23/02* (2013.01); *A63B 23/025* (2013.01); *A63B 23/0355* (2013.01); *A63B 23/03516* (2013.01); *A63B 23/1281* (2013.01); *A63B 2023/0411* (2013.01); *A63B 2208/0204* (2013.01); *A63B 2208/0233* (2013.01)

(58) Field of Classification Search
CPC ..... A63B 21/00; A63B 21/05; A63B 21/055; A63B 21/0555; A63B 21/0552; A63B 21/0557; A63B 23/02; A63B 21/023; A63B 23/1281; A63B 23/025; A63B 21/4033; A63B 23/0355; A63B 23/03516; A63B 2208/0233; A63B 2023/0411; A63B 2208/0204
See application file for complete search history.

(56) References Cited

U.S. PATENT DOCUMENTS 3,589,720 A * 6/1971 Agamian ..... A63B 21/012 310/69
3,620,530 A * 11/1971 Cosby ..... A63B 21/0552 482/130
4,376,533 A * 3/1983 Kolbel ..... A63B 21/00043 482/125
4,865,317 A * 9/1989 Hickey ..... A63B 21/05 482/126

(Continued)

*Primary Examiner* — Garrett K Atkinson
(74) *Attorney, Agent, or Firm* — Schacht Law Office, Inc.; Michael R. Schacht

(57) ABSTRACT

An exercise system comprising an extension section and a base section. The base section comprises a support assembly, a sleeve assembly, and a resilient member. The resilient member is arranged to resiliently oppose movement of the sleeve assembly in a compression direction relative to the support assembly. The extension section is detachably attachable to the sleeve assembly. The exercise system is operated in at least first and second configurations. In the first configuration, the extension section is detached from the sleeve assembly. In the second configuration, the extension section is detachably attached to the sleeve assembly such that the resilient member resiliently opposes movement of the sleeve assembly relative to the support assembly in the compression direction.

1 Claim, 20 Drawing Sheets

(56) References Cited

U.S. PATENT DOCUMENTS

| | | | | | |
|---|---|---|---|---|---|
| 5,071,119 | A * | 12/1991 | Johnson | A63B 21/0087 | 482/112 |
| 5,154,685 | A * | 10/1992 | Chen | A63B 21/00043 | 482/121 |
| 5,232,425 | A * | 8/1993 | Miller | A63B 21/0004 | 482/121 |
| 5,700,232 | A * | 12/1997 | Clausen | A63B 21/0552 | 482/125 |
| 5,749,815 | A * | 5/1998 | Lipps | A63B 23/0211 | 482/121 |
| 6,071,217 | A * | 6/2000 | Barnett | A63B 21/0552 | 482/121 |
| 6,206,811 | B1 * | 3/2001 | Lat | A63B 21/0004 | 482/126 |
| 6,976,942 | B2 * | 12/2005 | Kennedy | A63B 21/00043 | 482/122 |
| 7,288,052 | B1 * | 10/2007 | Guillaume | A63B 21/055 | 482/121 |
| 8,608,630 | B2 * | 12/2013 | Wu | A63B 23/02 | 482/121 |
| 9,180,332 | B1 * | 11/2015 | Tenorio | A63B 21/0557 | |
| 2005/0101457 | A1 * | 5/2005 | Tuller | A63B 21/0023 | 482/128 |

* cited by examiner

EXERCISE SYSTEMS AND METHODS

RELATED APPLICATIONS

This application, U.S. patent application Ser. No. 15/803,488 filed Nov. 3, 2017 claims priority of U.S. Provisional Patent Application Ser. No. 62/417,065, filed Nov. 3, 2016.

TECHNICAL FIELD

The present invention relates to an exercise system and methods of exercising and, in particular, to resistance exercise systems and methods that may be easily reconfigured for storage and use in different configurations.

BACKGROUND

A variety of exercise equipment is available to increase physical fitness of humans. Typically, exercise equipment is designed for a type of exercise (e.g., cardio training or strength training) and/or even for a specific body part or region (e.g., core, upper body, or lower body). Additionally, exercise equipment tends to be designed for younger individuals with a different capacity for exercise than older individuals. Finally, conventional sports equipment tends to be bulky or heavy and occupies a large amount of fixed space.

The need exists for multi-purpose exercise equipment that is small, collapsible, and portable and which is suitable for cardio or strength training, for the exercise of individual muscles or larger muscle groups, and for use by older individuals.

SUMMARY

The present invention may be embodied as an exercise system comprising an extension section and a base section. The base section comprises a support assembly, a sleeve assembly, and a resilient member. The resilient member is arranged to resiliently oppose movement of the sleeve assembly in a compression direction relative to the support assembly. The extension section is detachably attachable to the sleeve assembly. The exercise system is operated in at least first and second configurations. In the first configuration, the extension section is detached from the sleeve assembly. In the second configuration, the extension section is detachably attached to the sleeve assembly such that the resilient member resiliently opposes movement of the sleeve assembly relative to the support assembly in the compression direction.

The present invention may also be embodied as a method of exercising comprising the following steps. An extension section, a support assembly, a sleeve assembly, a resilient member, and a base section are provided. The a sleeve assembly is detachably attachable to the extension section. A base section is formed by arranging the resilient member to resiliently oppose movement of the sleeve assembly in a compression direction relative to the support assembly. The extension section is detachably attachable to the sleeve assembly, and a force is applied to the extension section such that the extension section is displaced relative to the support assembly in the compression direction. The extension section is detached from the sleeve assembly, and a force is applied to the sleeve assembly such that the sleeve assembly is displaced relative to the support assembly in the compression direction.

The present invention may also be embodied as an exercise system comprising an extension section and a base section. The extension section an extension brace assembly. The base section comprises a support assembly, a sleeve assembly, and a resilient member. The support assembly comprises a support member and a support brace assembly supported by the support member. The sleeve assembly comprises a sleeve member and a sleeve brace assembly supported by the sleeve member. The resilient member is arranged to resiliently oppose movement of the sleeve assembly in a compression direction relative to the support assembly. The extension section is detachably attachable to the sleeve assembly. The exercise system is operated in at least a first configuration and a second configuration. In the first configuration, the extension section is detached from the sleeve assembly and a first exercise force is applied to to the sleeve brace assembly to the force the sleeve assembly towards the support assembly in the compression direction. In the second configuration, the extension section is detachably attached to the sleeve assembly such that the resilient member resiliently opposes movement of the sleeve assembly relative to the support assembly in the compression direction and a second exercise force is applied to the extension brace assembly to force the sleeve assembly towards the support assembly in the compression direction.

DETAILED DESCRIPTION

Figure 1:
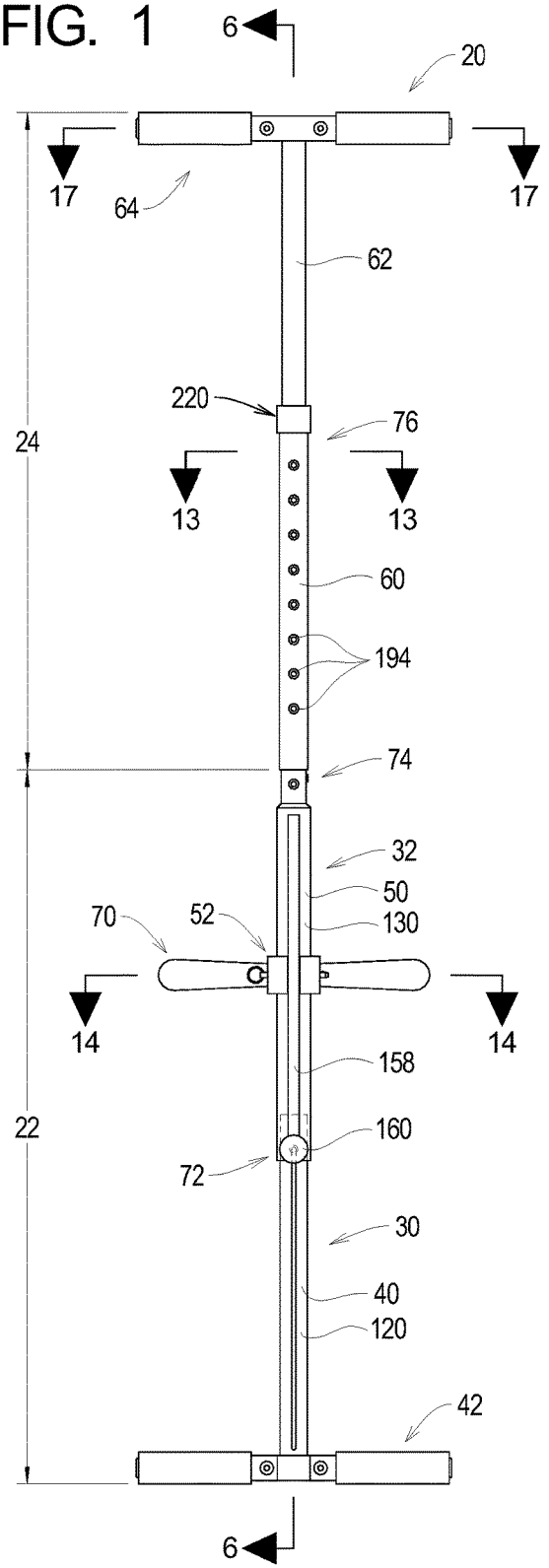
FIG. 1 is a front plan view of a first example exercise system of the present invention in a first configuration and in an expanded configuration.
Figure 2:
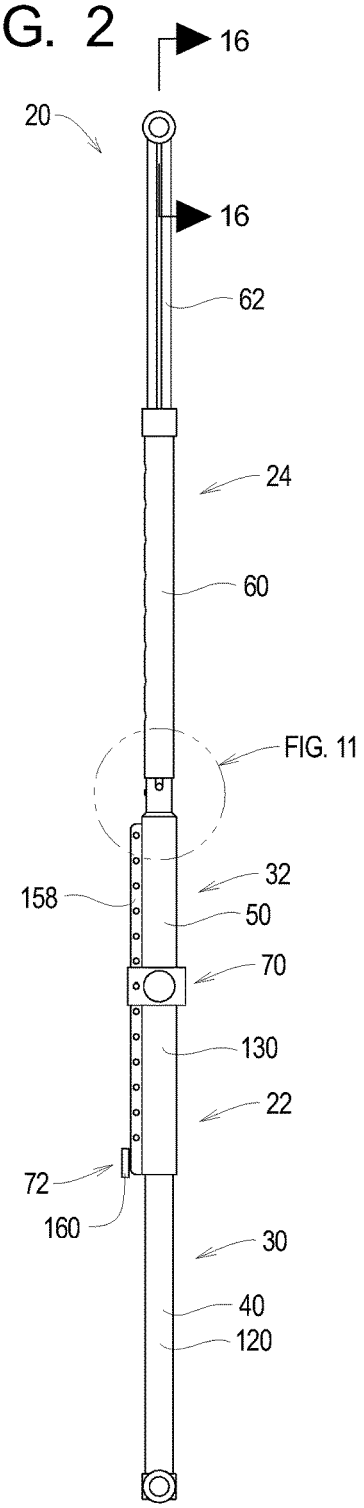
FIG. 2 is a side elevation view of the first example exercise system.

Referring initially to FIG. 1 of the drawing, depicted therein is a first example exercise system 20 constructed in accordance with, and embodying, the principles of the present invention. The first example exercise system 20 comprises a base section 22 and an extension section 24.

The example base section 22 is configured to move between compressed and expanded configurations. In particular, the example base section 22 is normally resiliently biased into the expanded position but a user may apply a force on at least one portion of the base section 22 to force the base section 22 at least partly into the compressed configuration. For a given base section 22, the amount of physical exertion applied to the base section 22 determines whether the base section 22 is partly or fully compressed. The example base section 22 is also at least partly reconfigurable to accommodate a particular user and a particular exercise. The example extension section 24 may be rigidly connected to a portion of the base section 22 to alter the size of the first example exercise system 20 as is appropriate for the particular user and the particular exercise being performed. The example base section 22 thus allows a number and type of resistance exercises to be performed, and the combination of the base section 22 and the extension section 24 substantially increases number and type of resistance exercises that can be performed using the first example exercise system 20.

The example base section 22 comprises a support assembly 30, a sleeve assembly 32, and a resilient member 34. The example support assembly 30 comprises a support tube 40 and a support brace assembly 42 supported at a predetermined position relative to the support tube 40. The example sleeve assembly 32 comprises a sleeve tube 50 and a sleeve brace assembly 52 supported at a desired position on the sleeve tube 50. The resilient member 34 is arranged within the support tube 40 and the sleeve tube 50 to resiliently oppose relative movement of the support brace assembly 42 and the sleeve brace assembly 52 towards each other.

The example extension section 24 comprises an extension tube 60, an extension rod 62, and an extension brace assembly 64. The extension brace assembly 64 is supported at a desired position relative to the extension rod 62. The sleeve rod 62 is detachably attached at any one of a plurality of positions relative to the extension tube 60 to allow the extension rod 62 to be supported at a desired position relative to the extension tube 60.

Figure 3:
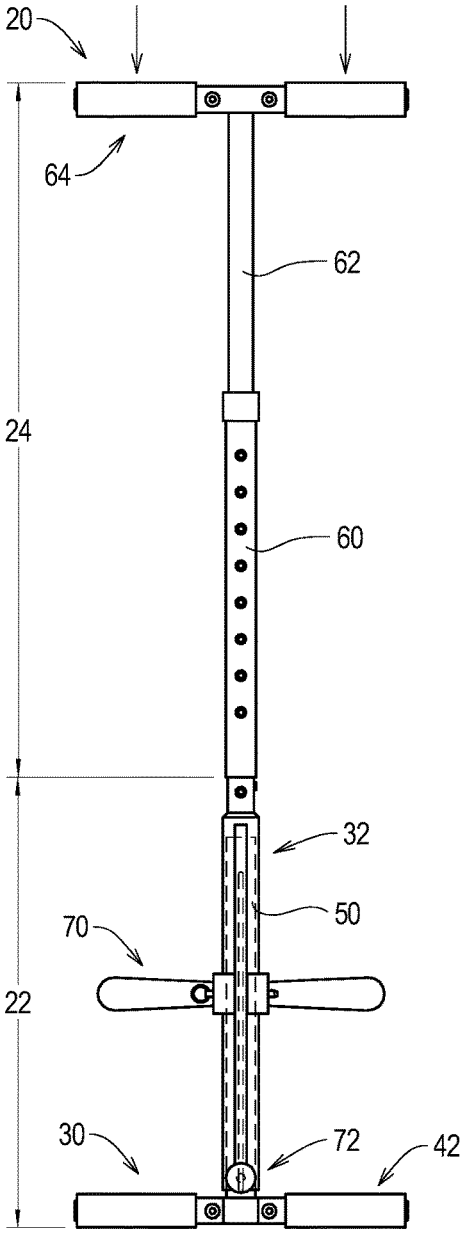
FIG. 3 is a front elevation view of the first example exercise system in the first configuration in a compressed configuration.
Figure 4:
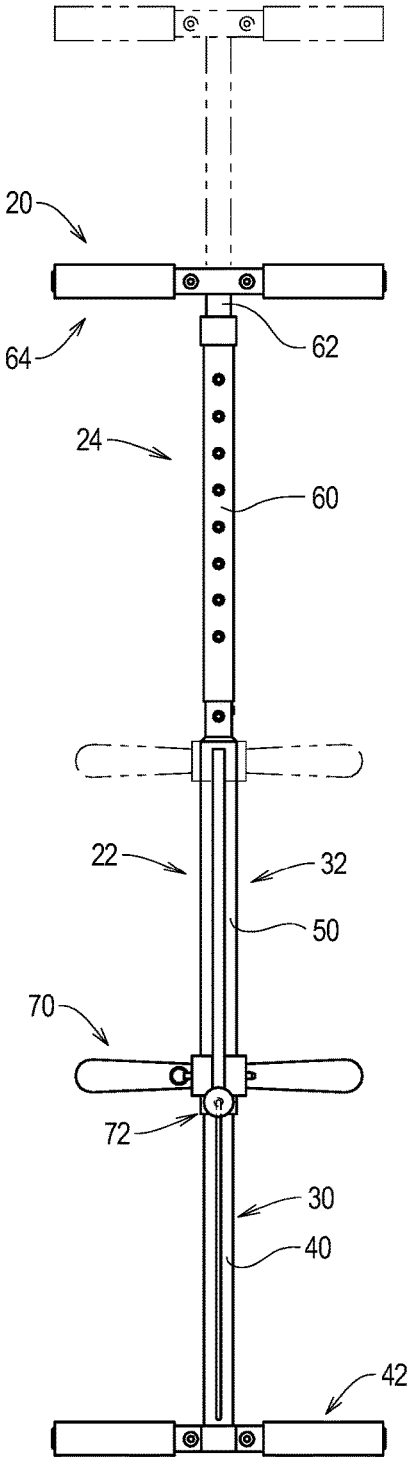
FIG. 4 illustrates ranges of movement between the front elevation views of the first example exercise system in the first configuration in compressed and expanded configurations, respectively.
Figure 6:
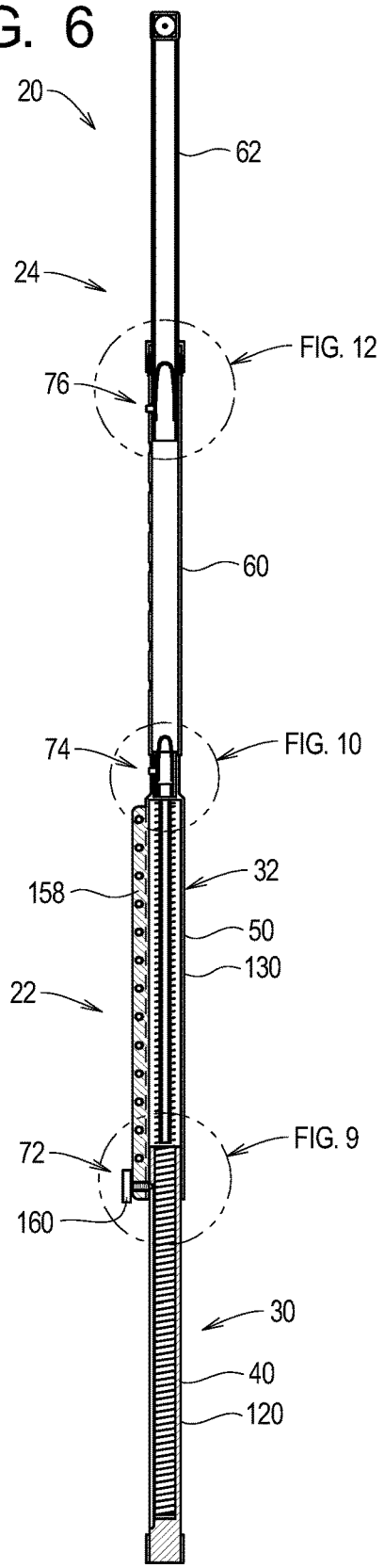
FIG. 6 is a side elevation section view of the first example exercise system in the first configuration and in the expanded configuration.
Figure 7:
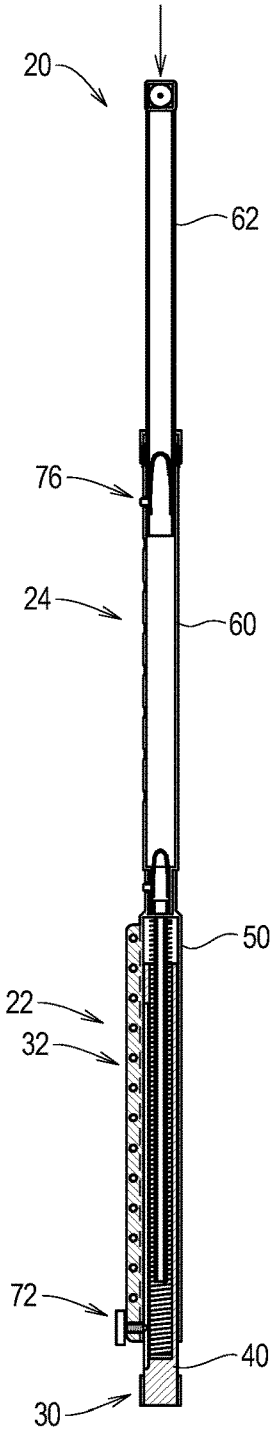
FIG. 7 is a side elevation section view of the first example exercise system in the first configuration and in the compressed configuration.
Figure 8:
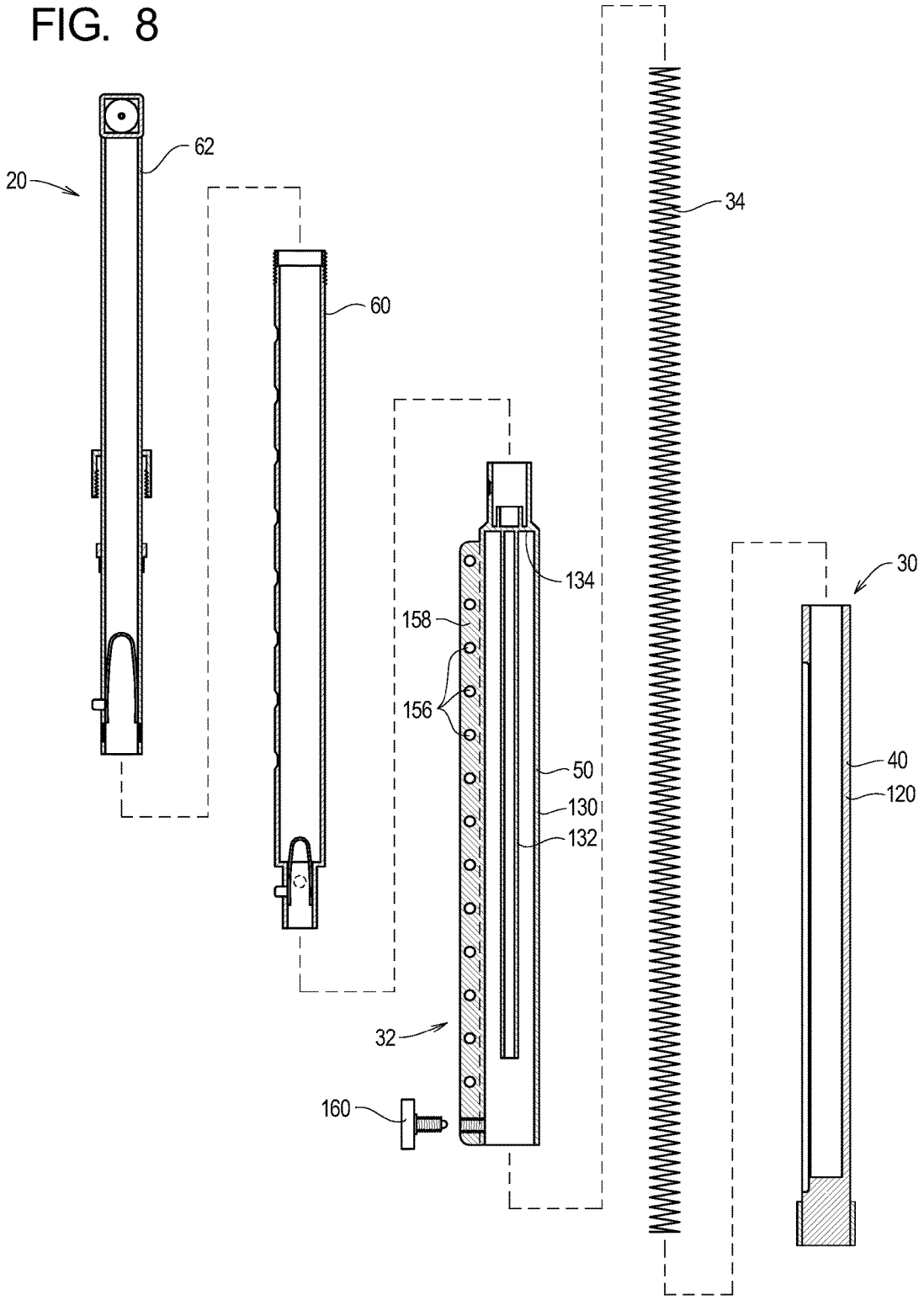
FIG. 8 is an exploded view illustrating the assembly of the first example exercise system.
Figure 12:
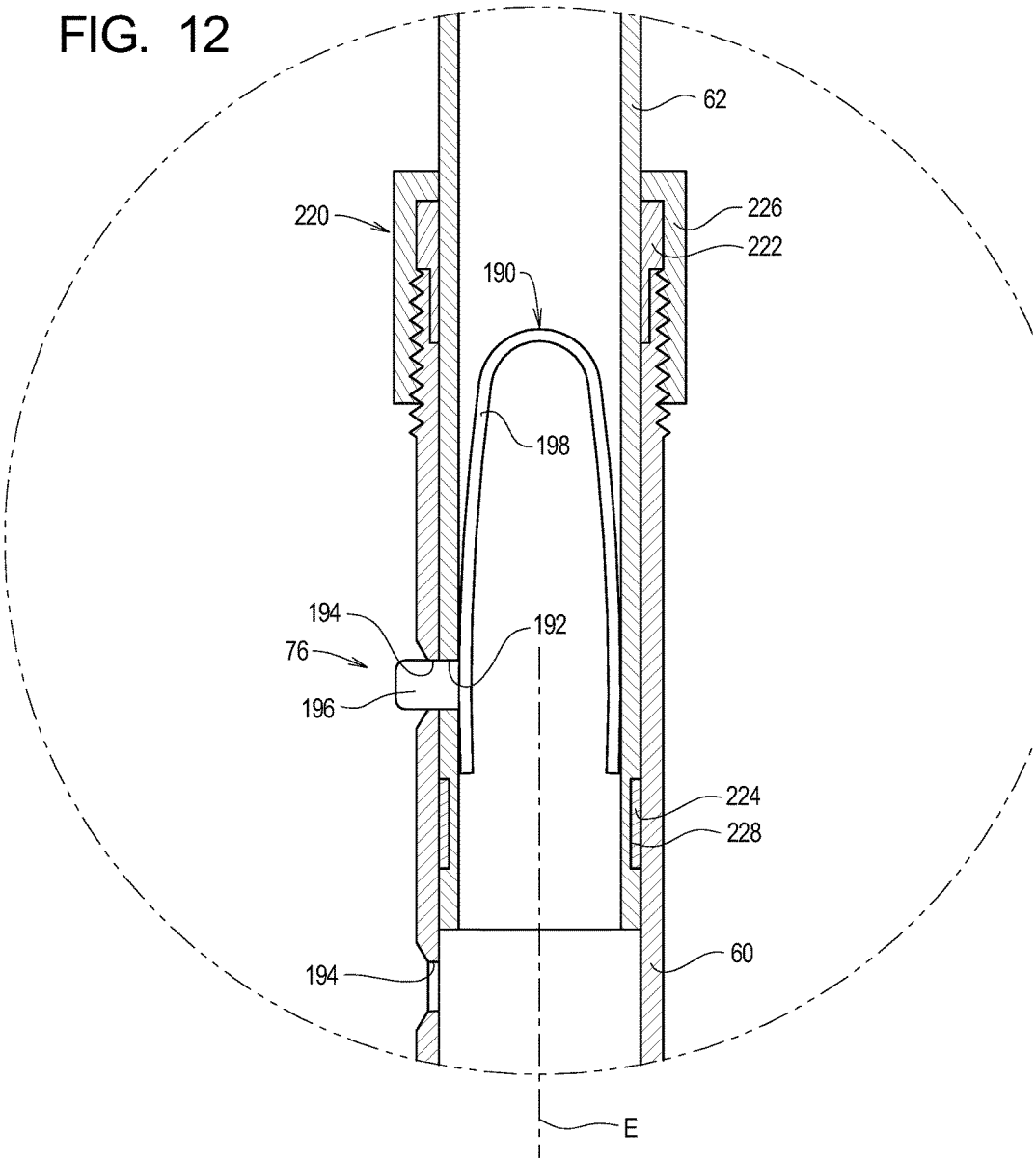
FIG. 12 is a detail view of FIG. 6 illustrating a third connector system of the first example exercise system.

The first example exercise system 20 further comprises a first connector system 70 (FIGS. 1, 14, and 15), a second connector system 72 (FIGS. 1, 6, and 9), a third connector system 74 (FIGS. 1, 6, and 10), and a fourth connector system 76 (FIGS. 1, 6, and 12). The example first connector system 70 detachably attaches the sleeve brace assembly 52 to the sleeve tube 50 at a desired position. The example second connector system 72 detachably supports the sleeve tube 50 to the support tube 40 for movement between an expanded configuration (FIG. 1) and a fully compressed configuration (FIG. 3). The example third connector system 74 detachably attaches the extension tube 60 to the sleeve tube 50. The example fourth connector system 76 detachably attaches the extension rod 62 to the extension tube 60 in a desired position.

Figure 9:
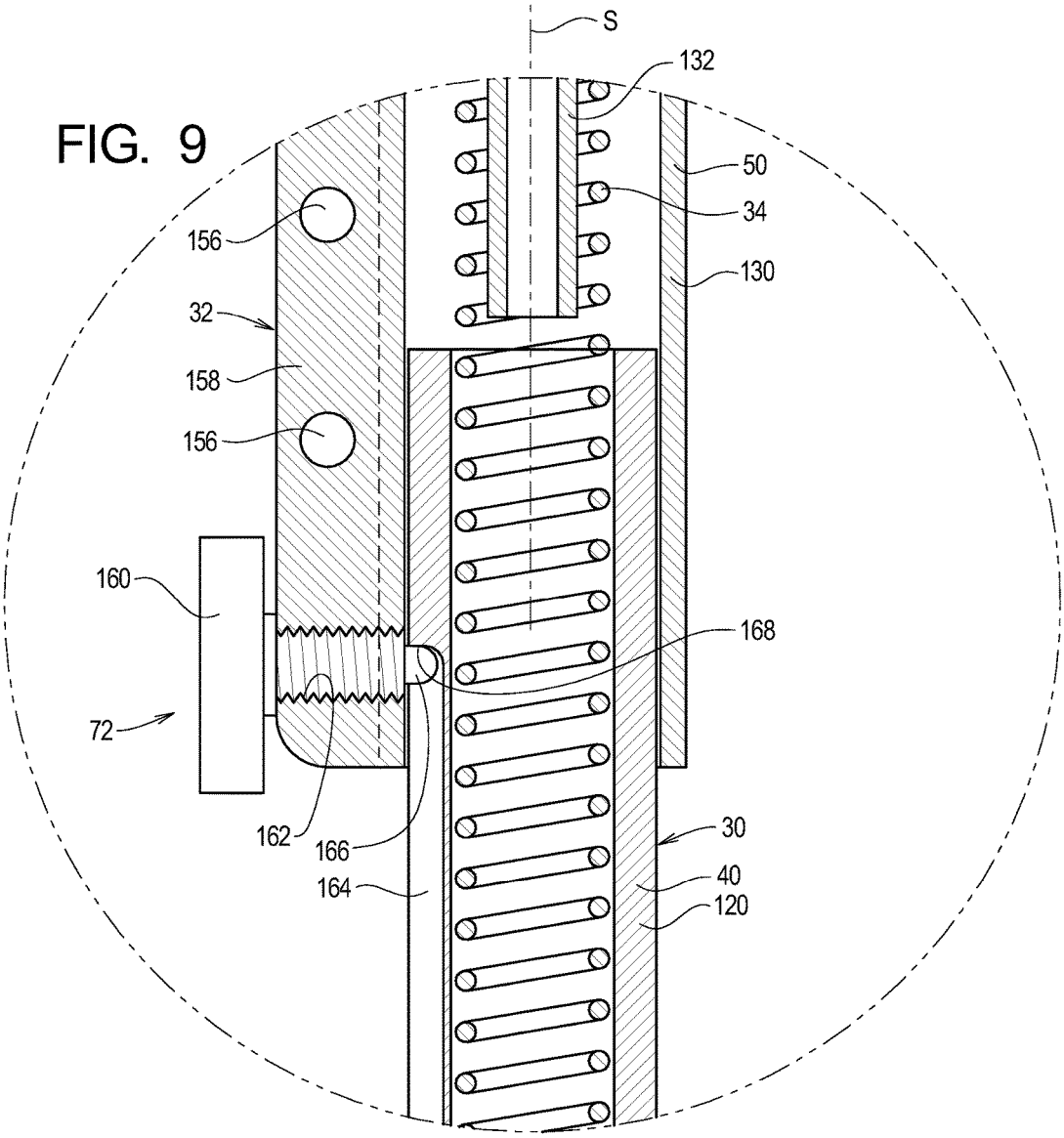
FIG. 9 is a detail view of FIG. 6 illustrating a first connector system of the first example exercise system.
Figure 10:
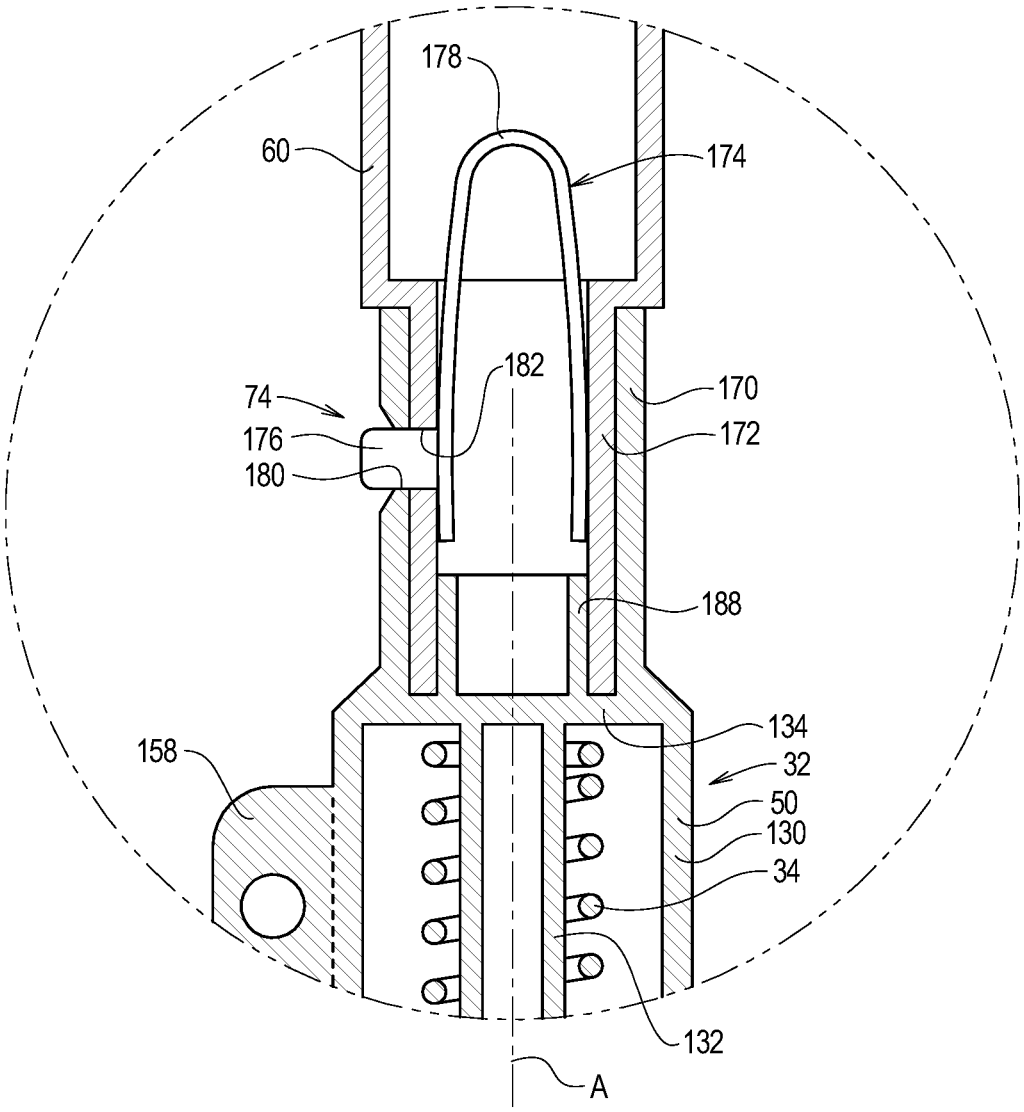
FIG. 10 is a detail view of FIG. 6 illustrating a second connector system of the first example exercise system.

As perhaps best shown in FIGS. 1-10 and 14, the example support tube 40 comprises a support tube body 120 and the example sleeve tube 50 comprises a sleeve tube outer body 130 and a sleeve tube inner body 132. As shown in FIG. 10, the sleeve tube outer body 130 and sleeve tube inner body 132 are rigidly supported in a coaxial arrangement relative to each other by a sleeve tube bridge plate 134. The example bridge plate 134 further engages one end of the resilient member 34 as shown in FIG. 10.

Figure 14:
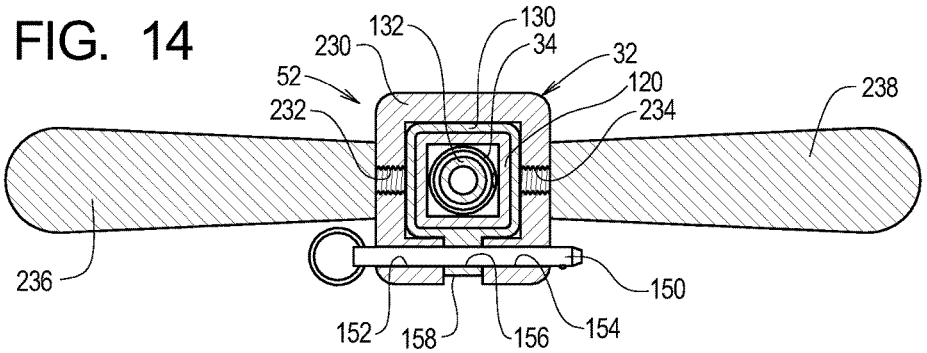
FIG. 14 is a section view taken along lines 14-14 in FIG. 1 illustrating a fourth connector system of the first example exercise system in a locked configuration.

FIG. 14 illustrates that the example support tube body 120 and example sleeve tube body 130 are both substantially square in cross-section. Further, at least the sleeve tube body 130 is hollow and the support tube body 120 is sized and dimensioned to fit snugly within the sleeve tube body 130 in a telescoping manner along a support axis S (FIG. 9). The example support tube body 120 is also hollow. The corners of the square cross-sections of the tube body 120 and sleeve body 130 allow linear movement of the sleeve tube 50 relative to the support tube 40 along the support axis S but prevent rotation of the sleeve tube 50 relative to the support tube 40 about the support axis S.

Figure 13:
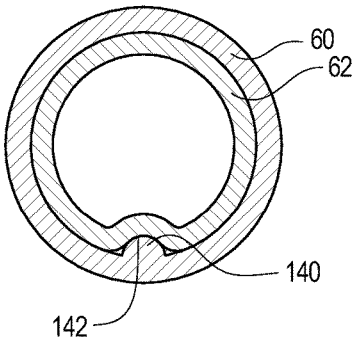
FIG. 13 is a section view taken along lines 13-13 in FIG. 1.

FIG. 13 illustrates that the example extension tube 60 defines an extension tube projection 140 and that the example extension rod 62 defines an extension rod groove 142. The example extension tube 60 and example extension rod 62 are both generally circular in cross-section. Further, at least the extension tube 60 is hollow and the support extension rod 62 is sized and dimensioned to fit snugly within the extension tube 60 in a telescoping manner along an extension axis E (FIG. 12). The example extension rod 62 is also hollow. The extension rod groove 142 receives the extension tube projection 140 such that linear movement of the extension rod 62 along the extension axis E relative to the extension tube 60 is allowed but rotation of the extension rod 62 about the extension axis E relative to the extension tube 60 is prevented.

The example first connector system 70 comprises a lock pin 150, first and second brace lock openings 152 and 154 formed in the sleeve brace assembly 52, and a plurality of support openings 156 formed in a support flange 158 extending from the sleeve tube body 130. Using the first connector system 70, the sleeve brace assembly 52 is fixed relative to the sleeve tube 50 along the support axis S at a desired position. The desired position corresponds to a desired distance between the sleeve brace assembly 52 and the support brace assembly 42.

Figure 15:
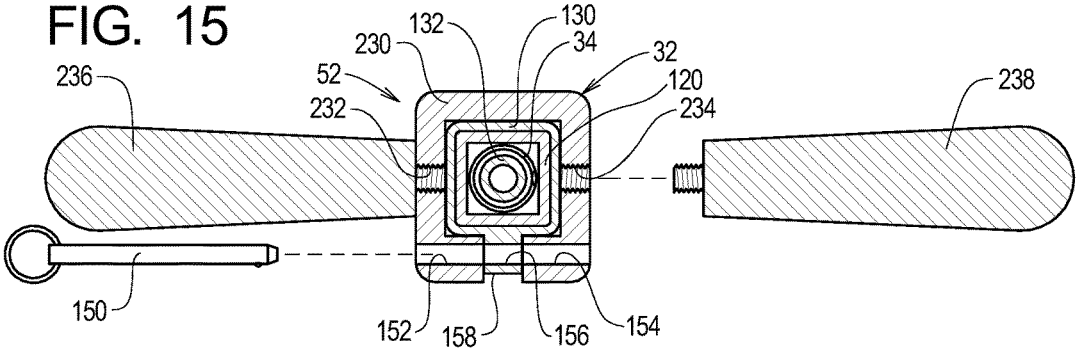
FIG. 15 is a section view similar to FIG. 14 illustrating the fourth connector system in an unlocked configuration.
Figure 16:
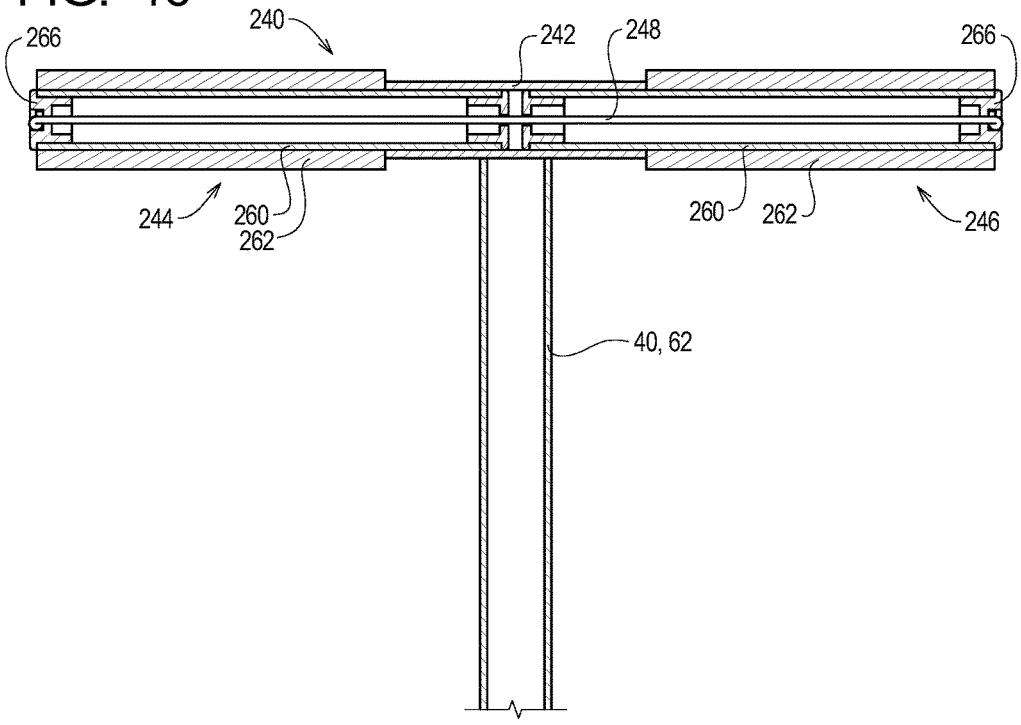
FIG. 16 is a section view taken along lines 16-16 in FIG. 2 illustrating the extension brace assembly in a use configuration.
Figure 17:
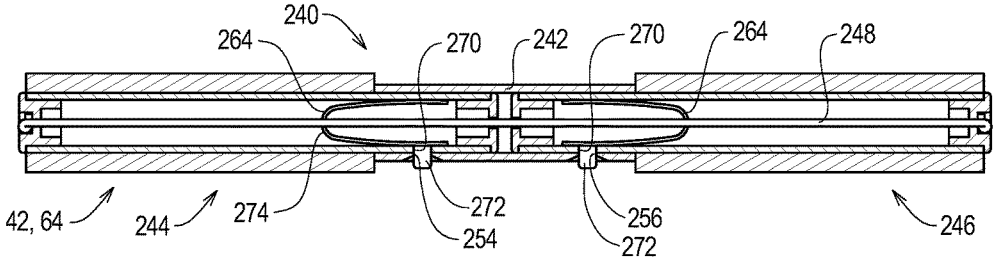
FIG. 17 is a section view taken along lines 17-17 in FIG. 1 illustrating the extension brace assembly in the use configuration.
Figure 18:
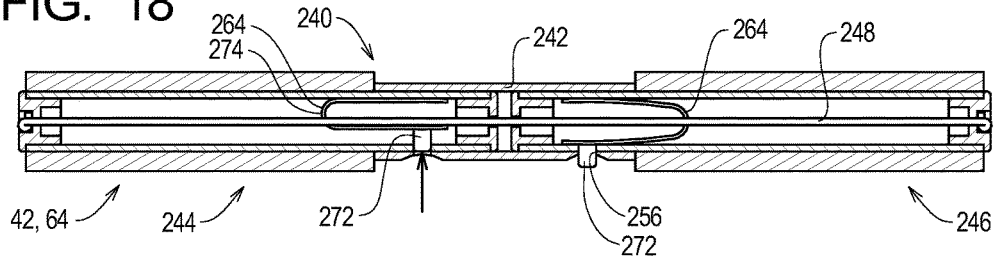
FIG. 18-21 are section views similar to FIG. 17 illustrating the process of reconfiguring the extension brace assembly from the use configuration into a storage configuration.
Figure 19:
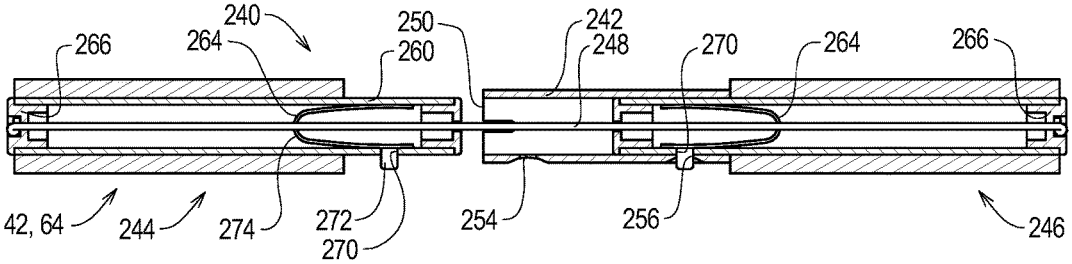
Figure 20:
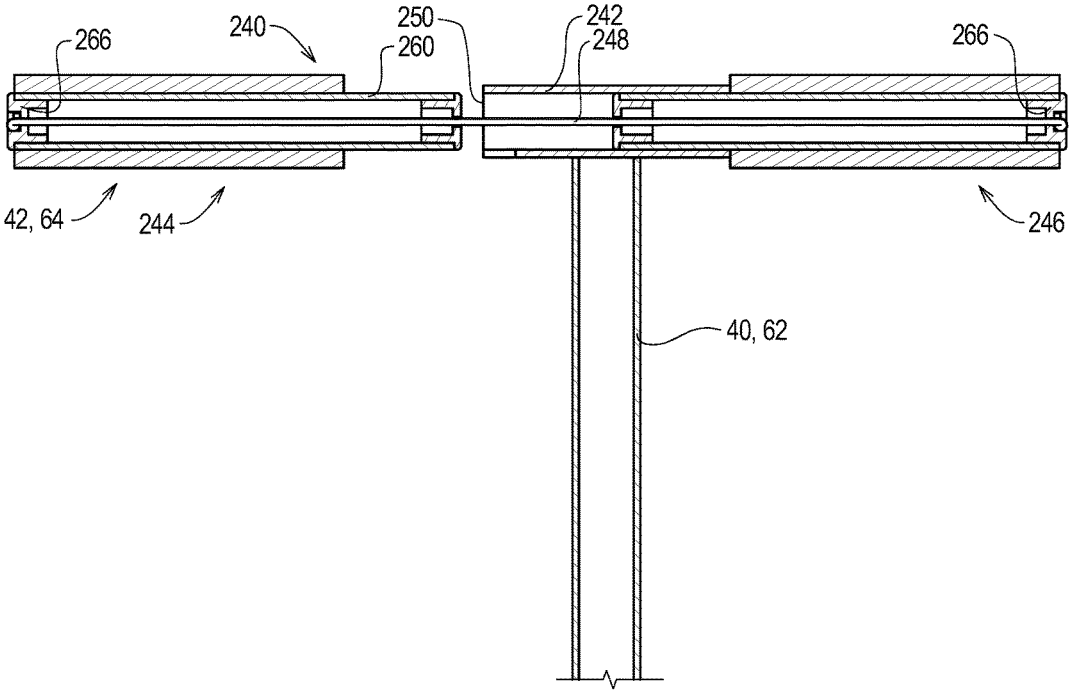
Figure 21:
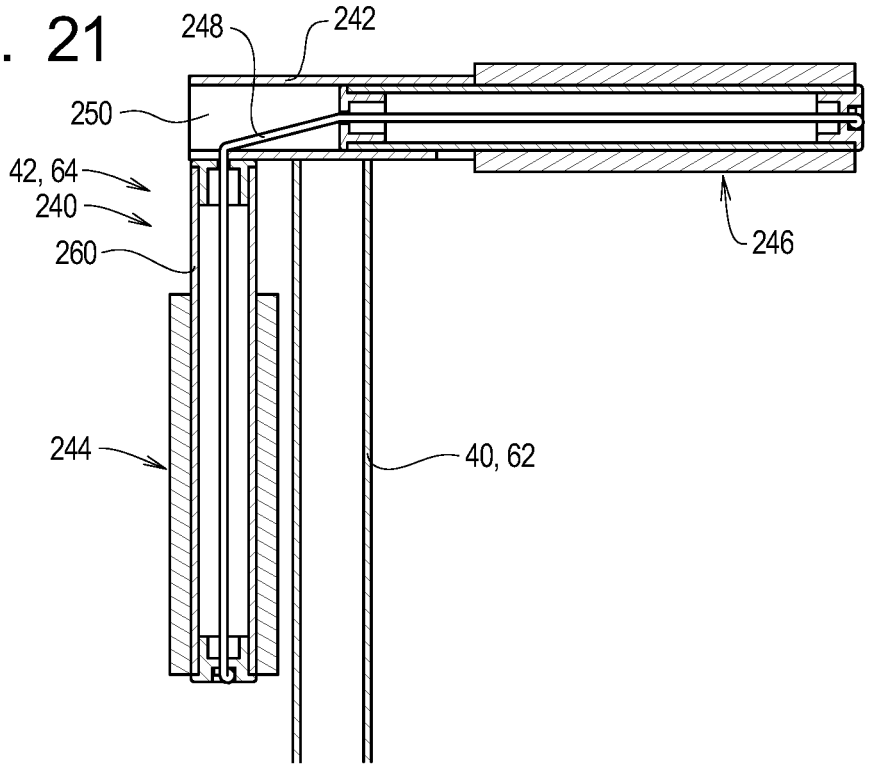
Figure 22:
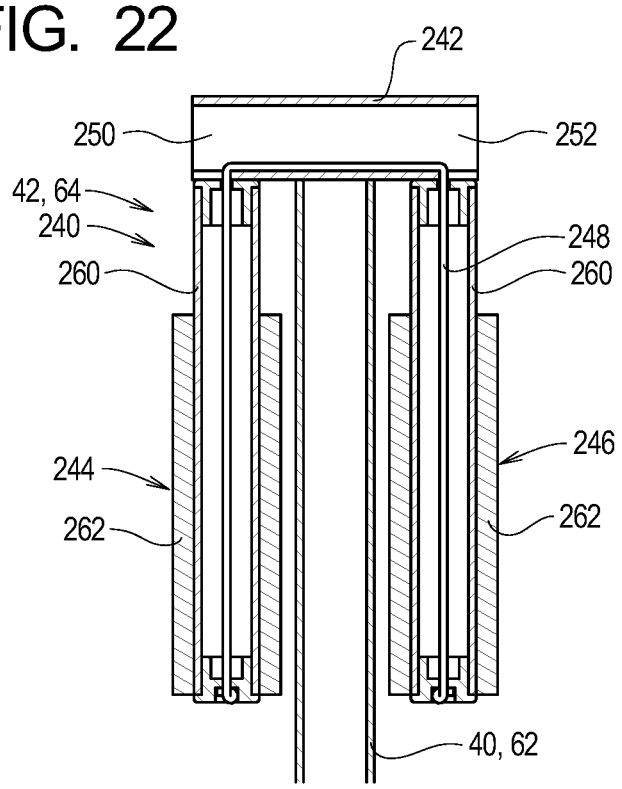
FIG. 22 is a section view similar to FIG. 17 illustrating the extension brace assembly in the storage configuration.
Figure 23:
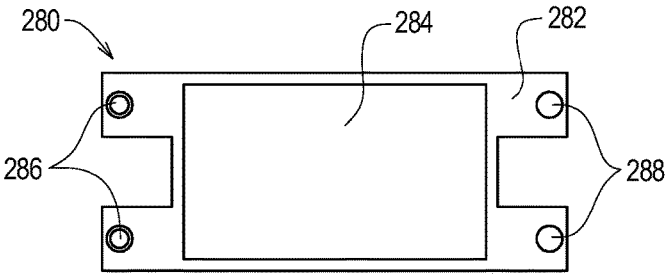
FIG. 23 is a top plan view of a brace pad in a flat configuration, where the brace pad may be used with the first example exercise system.
Figure 24:
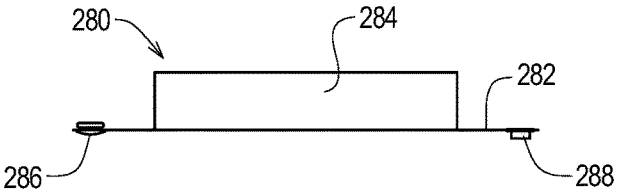
FIG. 24 is a side elevation view of the brace pad in the flat configuration.
Figure 25:
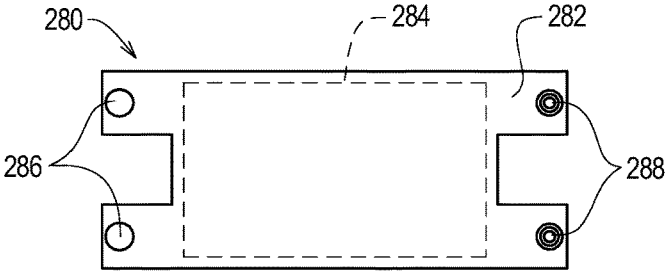
FIG. 25 is a bottom plan view of the brace pad in the flat configuration.
Figure 26:
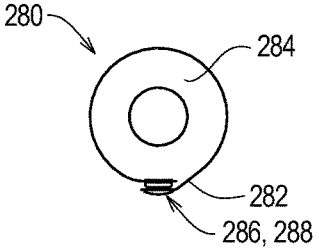
FIG. 26 is a side elevation view of the brace pad in a rolled configuration.
Figure 27:
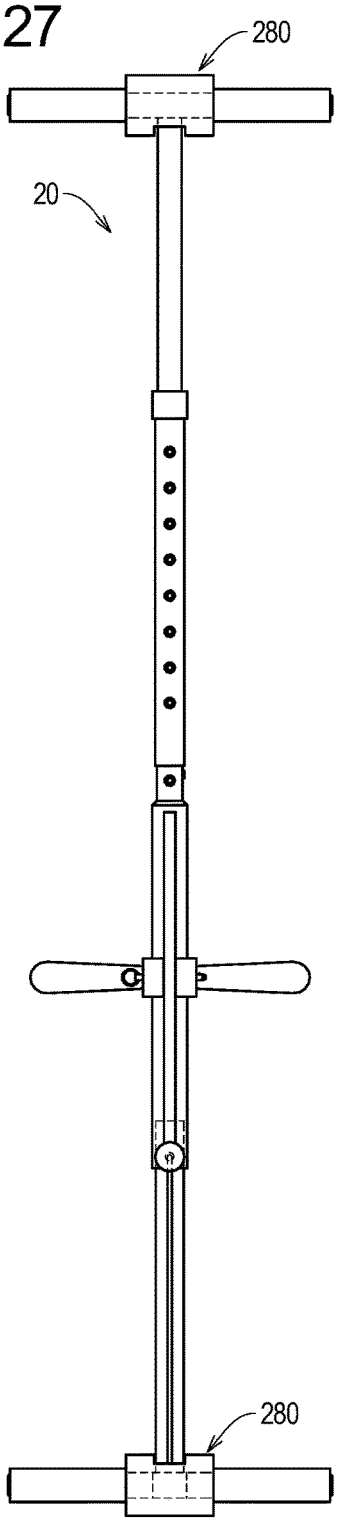
FIG. 27 is a side elevation view illustrating optional brace pads connected to a support brace assembly and an extension brace assembly of the first example exercise system.
Figure 28A:
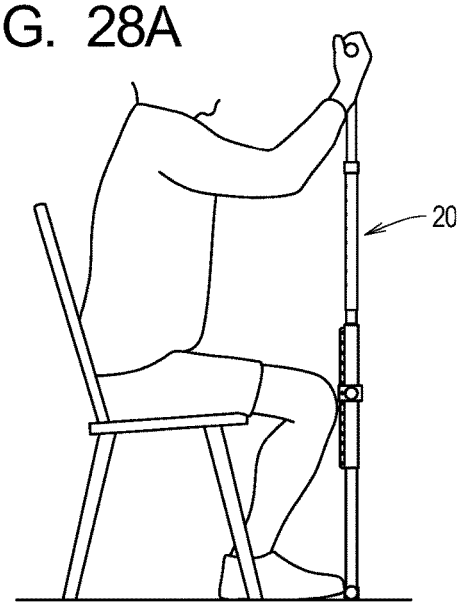
FIGS. 28A and 28B illustrate a first example exercise performed using the first example exercise system.
Figure 28B:
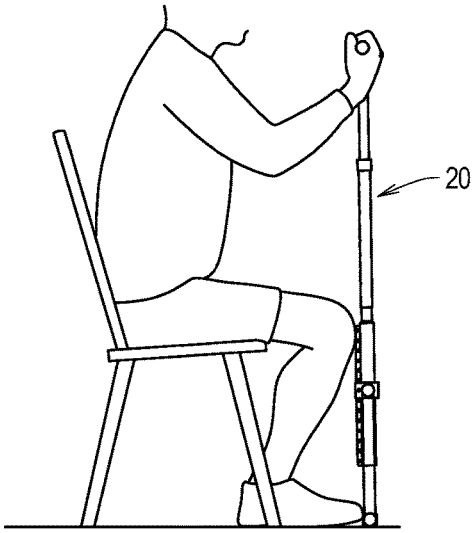
Figure 29A:
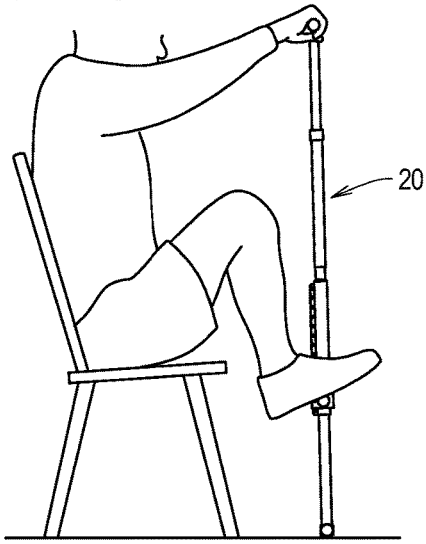
FIGS. 29A and 29B illustrate a second example exercise performed using the first example exercise system.
Figure 29B:
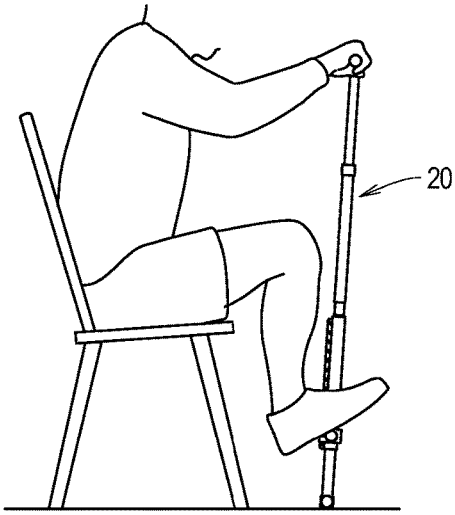
Figure 30A:
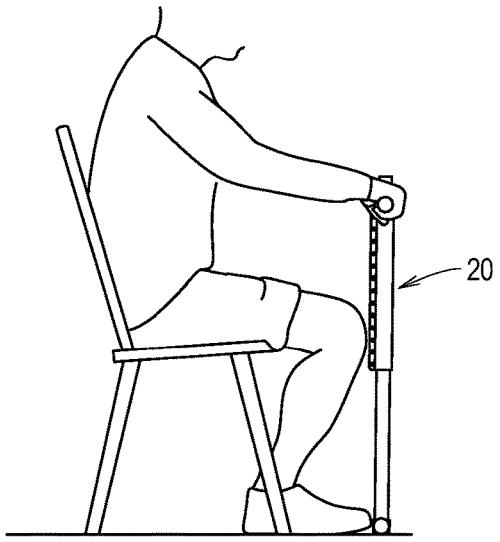
FIGS. 30A and 30B illustrate a third example exercise performed using the first example exercise system.
Figure 30B:
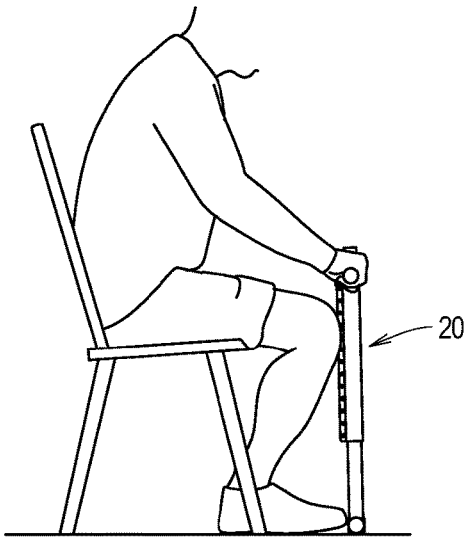
Figure 31A:
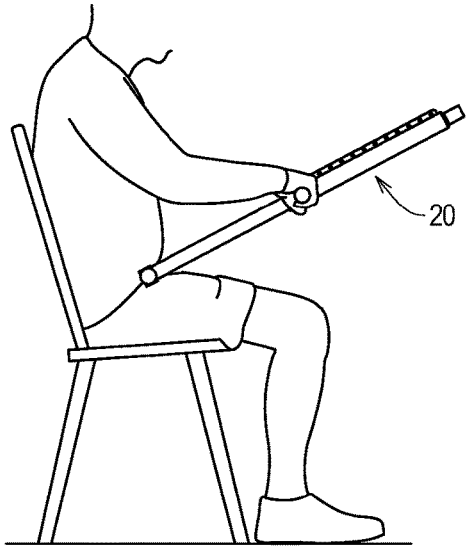
FIGS. 31A and 31B illustrate a fourth example exercise performed using the first example exercise system.
Figure 31B:
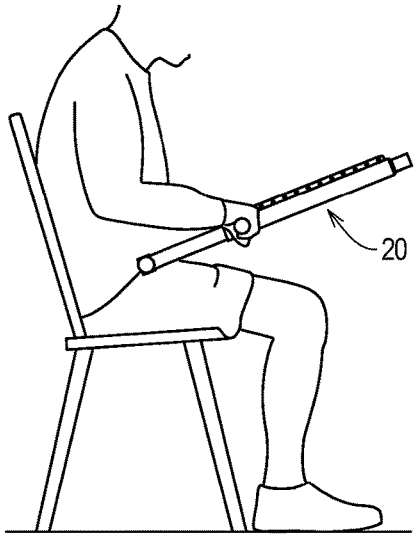
Figure 32A:
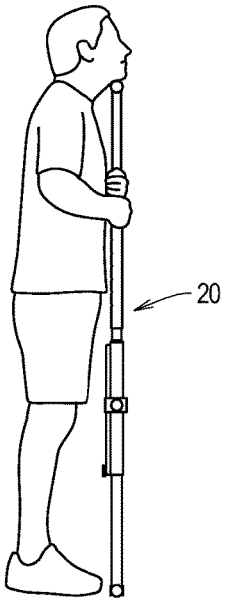
FIGS. 32A, 32B, and 32C illustrate a fifth example exercise performed using the first example exercise system.
Figure 32B:
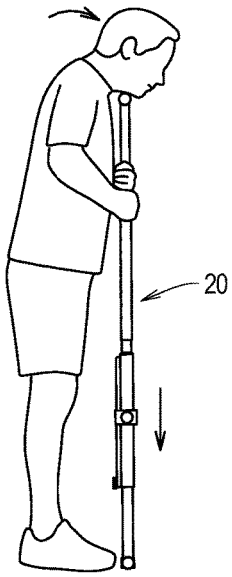
Figure 32C:
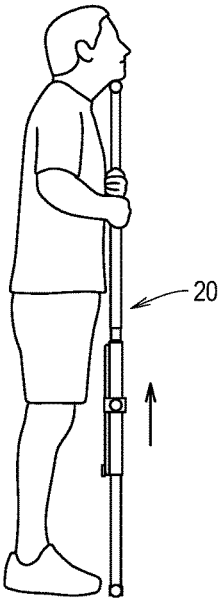
Figure 33A:
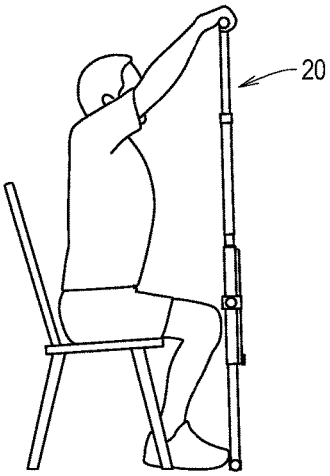
FIGS. 33A, 33B, and 33C illustrate a sixth example exercise performed using the first example exercise system.
Figure 33B:
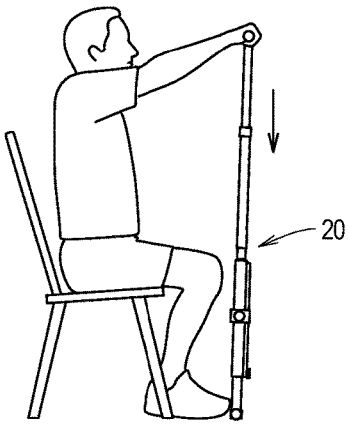
Figure 33C:
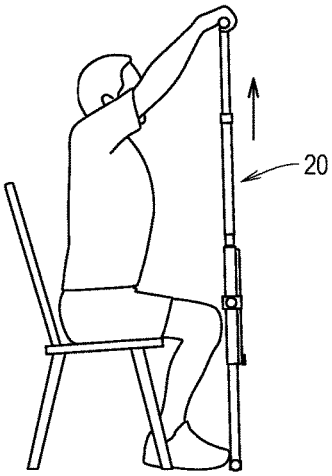
Figure 34A:
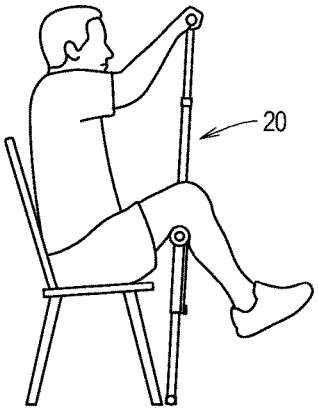
FIGS. 34A, 34B, and 34C illustrate a seventh example exercise performed using the first example exercise system.
Figure 34B:
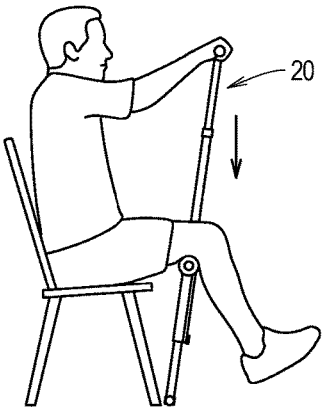
Figure 34C:
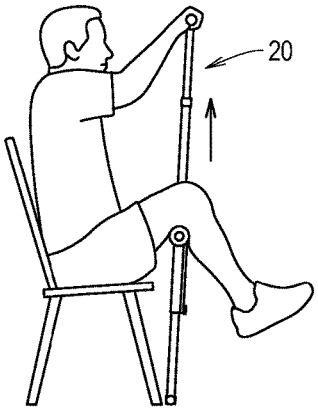
Figure 35A:
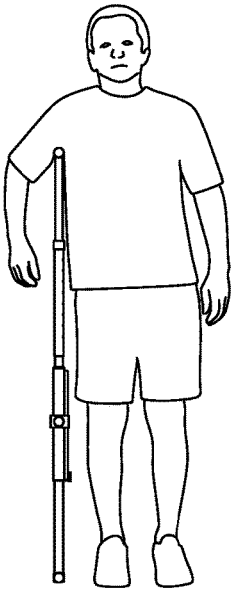
FIGS. 35A, 35B, and 35C illustrate an eighth example exercise performed using the first example exercise system.
Figure 35B:
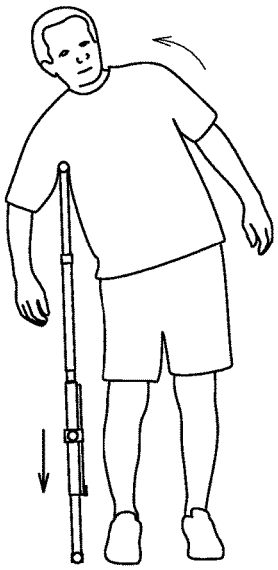
Figure 35C:
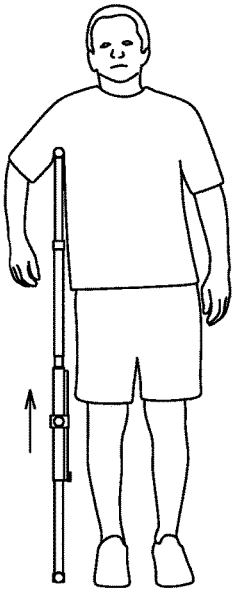
Figure 36A:
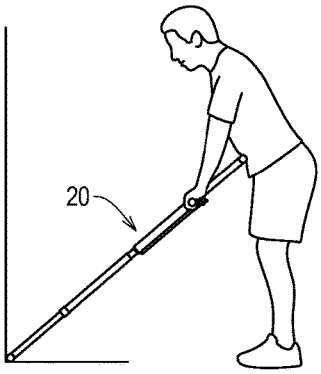
FIGS. 36A, 36B, and 36C illustrate a ninth example exercise performed using the first example exercise system.
Figure 36B:
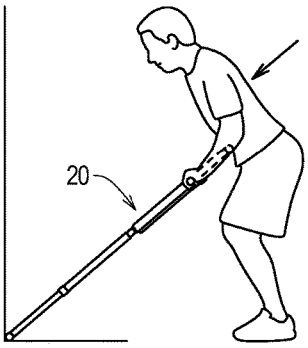
Figure 36C:
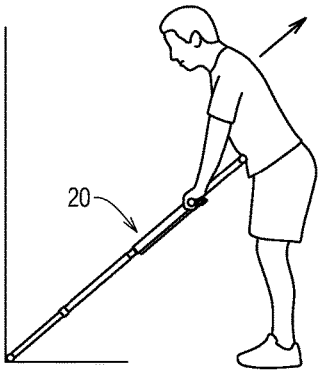
Figure 37A:
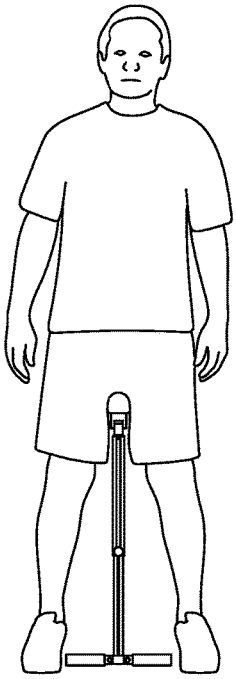
FIGS. 37A, 37B, and 37C illustrate a tenth example exercise performed using the first example exercise system.
Figure 37B:
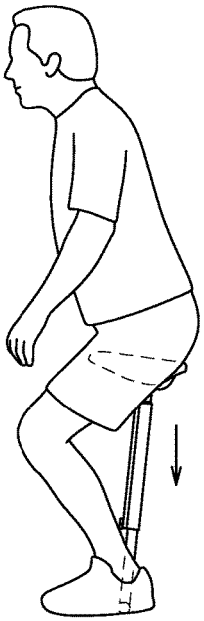
Figure 37C:
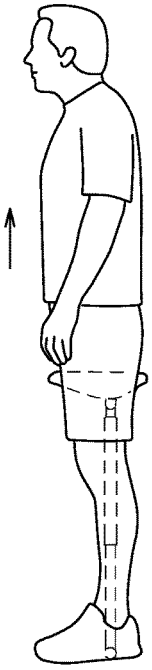
Figure 38A:
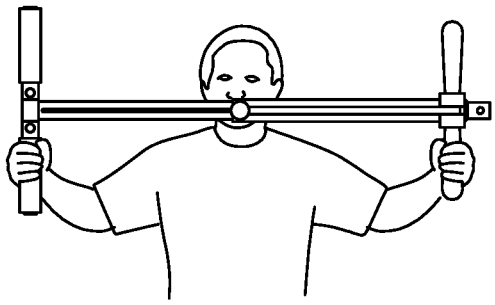
FIGS. 38A, 38B, and 38C illustrate an eleventh example exercise performed using the first example exercise system.
Figure 38B:
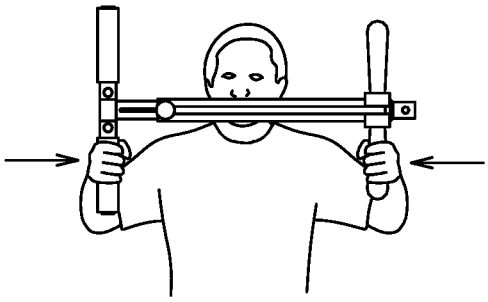
Figure 38C:
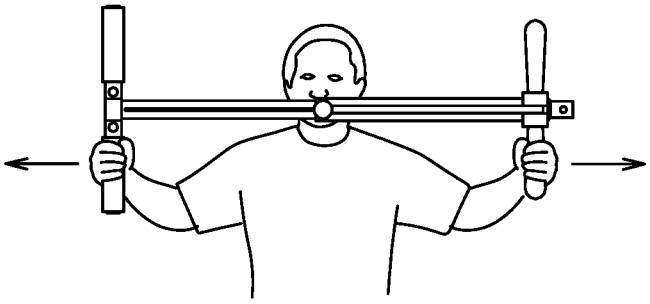

The desired position is obtained by identifying a desired support opening 156 from the plurality of support openings 156, aligning the desired support opening 156 with the first and second brace lock openings 152 and 154, and inserting the lock pin 150 through the aligned openings 152, 154, and 156. As shown in FIG. 14, inserting the lock pin 150 through the first sleeve lock opening 152, a selected one of the sleeve brace lock openings 156, and through the second sleeve opening 154 prevents linear movement of the sleeve brace assembly 52 relative to the sleeve tube 50 along the support axis S. FIG. 15 illustrates that with the lock pin 150 removed, nothing prevents linear movement of the sleeve brace assembly 52 relative to the sleeve tube 50 along the support axis S.

Although the example first connector system 70 comprises a lock pin extended through aligned holes in a support flange, connector systems in addition or instead of the example first connector system 70 may be used. For example, support openings may be formed directly in a sleeve tube body, and the pin may extend through one or two brace lock openings in the sleeve brace assembly and one or more of the support openings in the sleeve tube body. As another example, a spring detent may be supported by the sleeve brace assembly 52 to extend into openings formed in the sleeve tube 50. As yet another example, slots may be formed along the length of the sleeve tube 50, and a metal ring rotatably attached to the sleeve brace assembly 52 may be rotated into an unlocked position in which the ring does not engage the slots and a locked position in which the ring engages one of the slots. In any case, the first connector system 70 shall be sufficiently rigidly connected to a desired location on the sleeve tube 50 to accommodate a maximum return force created by the resilient member 34 as will be described in further detail below.

The example second connector system 72 is configured to detachably attach the sleeve tube 50 to the support tube 40 such that the sleeve tube 50 can move within a limited range of movement along the support axis S relative to the support tube 40. In particular, as perhaps best shown in FIG. 9, the example second connector system 72 comprises a limit member 160, a limit opening 162 formed in the sleeve tube 50, and a slot or groove 164 formed in the support tube 40. The resilient member 34 is arranged such that a portion of the resilient member 34 is within the support tube 40 and a portion of the resilient member 34 is outside of the support tube 40. The portion of the resilient member 34 outside of the support tube 40 is next inserted into the sleeve tube 50 until a portion of the support tube 40 enters the sleeve tube 50 as shown in FIG. 9. The example limit member 160 is extended through the limit opening 162 such that a tip 166 of the limit member 160 is within the slot or groove 164. As shown in FIG. 9, the tip 166 of the limit member 160 engages an end 168 of the slot or groove 164 to prevent the portion of the support tube 40 within the sleeve tube 50 from being removed. However, simply altering the position of the limit member 160, the tip 166 thereof is removed from the slot or groove 164 and is no longer capable of engaging the slot end 168. At this point, the support tube 40 may be disengaged from the sleeve tube 50.

The example limit member 160 thus defines a first end of the range of motion between the support tube 40 and the sleeve tube 50 along the support axis S. A second end of this range of motion is defined by the resilient member 34 and/or a second end (not shown) of the slot or groove 164.

Figure 11A:
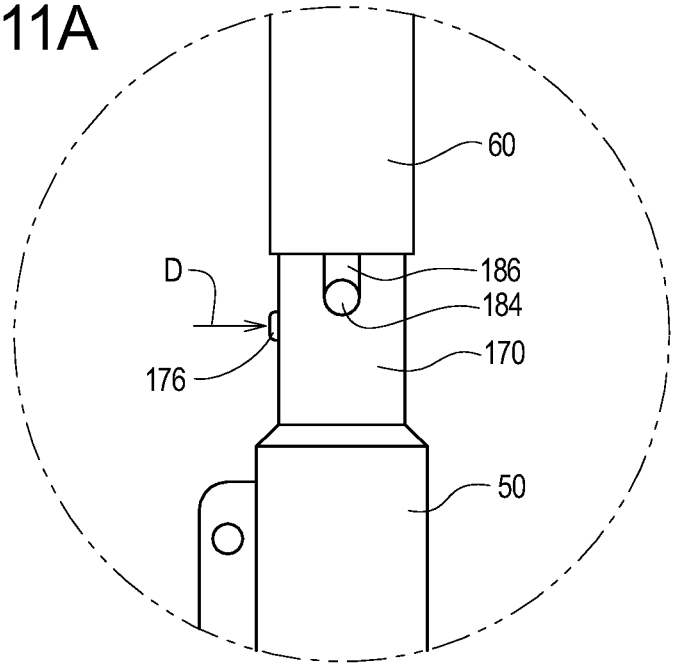
FIG. 11A is a detail view of FIG. 2 illustrating the second connector system in a connected configuration.
Figure 11B:
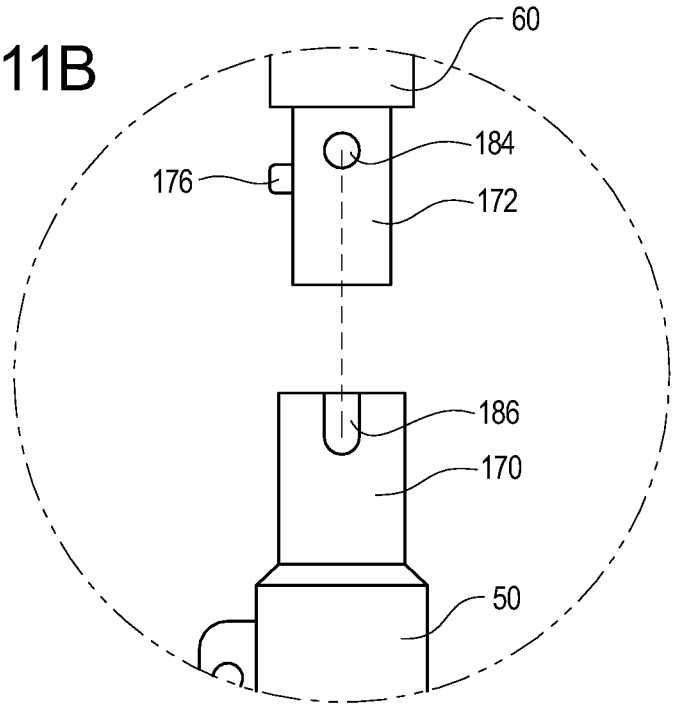
FIG. 11B is a detail view similar to FIG. 11A illustrating the second connector system in a disconnected configuration.

Turning now to FIGS. 10, 11A, and 11B of the drawing, the example third connector system 74 will now be described in further detail. The example third connector system 74 comprises a first connector portion 170 formed on the sleeve tube 50, a second connector portion 172 formed on the extension tube 60, and a detent member 174 supported by the second connector portion 172. The detent member 174 defines a detent projection 176 and a resilient portion 178. A first detent opening 180 is formed in the first connector portion 170, a second detent opening 182 is formed in the second connector portion 172, an alignment projection 184 extends from the second connector portion 172, and an alignment slot 186 is formed in the first connector portion 170. The example first connector portion 170 further comprises an inner projection 188. The first connector portion 170 and inner projection 188 both extend from the end plate 134 in a direction opposite that of the sleeve tube outer and inner bodies 130 and 132.

The extension section 24 is optionally connected to the base section 22 by placing the example third connector system 74 into a connected configuration as shown in FIGS. 10 and 11A. In the connected configuration, the alignment slot 186 receives the alignment projection 184 and the detent projection 176 extends through the detent openings 180 and 182. The resilient portion 178 biases the detent projection 176 through the detent openings 180 and 182. At the same time, the second connector portion 172 is snugly received between the first connector portion 170 and the inner projection 188 such that the support axis S and extension axis E are aligned to define a system axis A. The extension tube 60 is thus prevented from movement along the system axis A relative to the support sleeve 50 by the engagement of the detent projection 176 with the detent openings 180 and 182 and from rotating about the system axis A relative to the support sleeve 50 by the engagement of the alignment projection 184 with the alignment slot 186. The engagement of the second connector portion 172 with the first connector portion 170 and the inner projection 188 encourages alignment of the support axis S and extension axis E during use of the exercise system 20.

To disconnect the extension section 24 from the base section 22, the detent projection 176 is depressed as shown by arrow D in FIG. 11A until the detent projection 176 is substantially passed through the first detent opening 180. At this point, the extension tube 60 may be displaced away from the sleeve tube 50 along the system axis A to disconnect the extension section 24 from the base section 22.

Connector systems and methods other than the example third connector system 74 may be used to detachably attach the extension section 24 to the base section 22. For example, matching threaded surfaces may be formed on the first and second connector portions 170 and 172 that allow the extension tube 60 to be threaded on to the sleeve tube 50.

Referring now to FIG. 12, the example fourth connector system 76 will now be described. The example fourth connector system 76 comprises a detent member 190 supported within the extension rod 62, a first detent opening 192 formed in the extension rod 62, and a plurality of second detent openings 194 formed in the extension tube 60. The example detent member 190 comprises a detent projection 196 and a resilient portion 198.

To detachably attach the extension rod 62 to the extension tube 60 to obtain a desired length of the extension section 24, the extension rod 62 is inserted into the extension tube 60 until the first detent opening 192 is aligned with a desired one of the second detent openings 194 corresponding the desired length. When the first detent opening 192 is aligned with the desired second detent opening 194, the resilient portion 198 forces the detent projection 196 through the desired second detent opening 194 to place the example fourth connector system 76 into a locked configuration as shown in FIG. 12. In the locked configuration, the extension rod 62 is prevented from moving along or axially rotating about the extension axis E relative to the extension tube 60 by engagement of the detent projection 196 with the first detent opening 192 and the desired second detent opening 194.

The example fourth connector system 76 may be placed in an unlocked configuration by depressing the detent projection 196 against the biasing force of the resilient portion 198 until the detent projection 196 is substantially removed from the desired second detent opening 194. In the unlocked configuration, the extension rod 62 may be moved along the extension axis E relative to the extension tube 60 to obtain a different desired length or completely detached from the extension tube 60 for storage.

Connector systems and methods other than the example fourth connector system 76 may be used to alter the effective length of the extension section 24. For example, a plurality of extension segments defining matching threaded surfaces may connect to together to define a plurality of different lengths.

Figure 5:
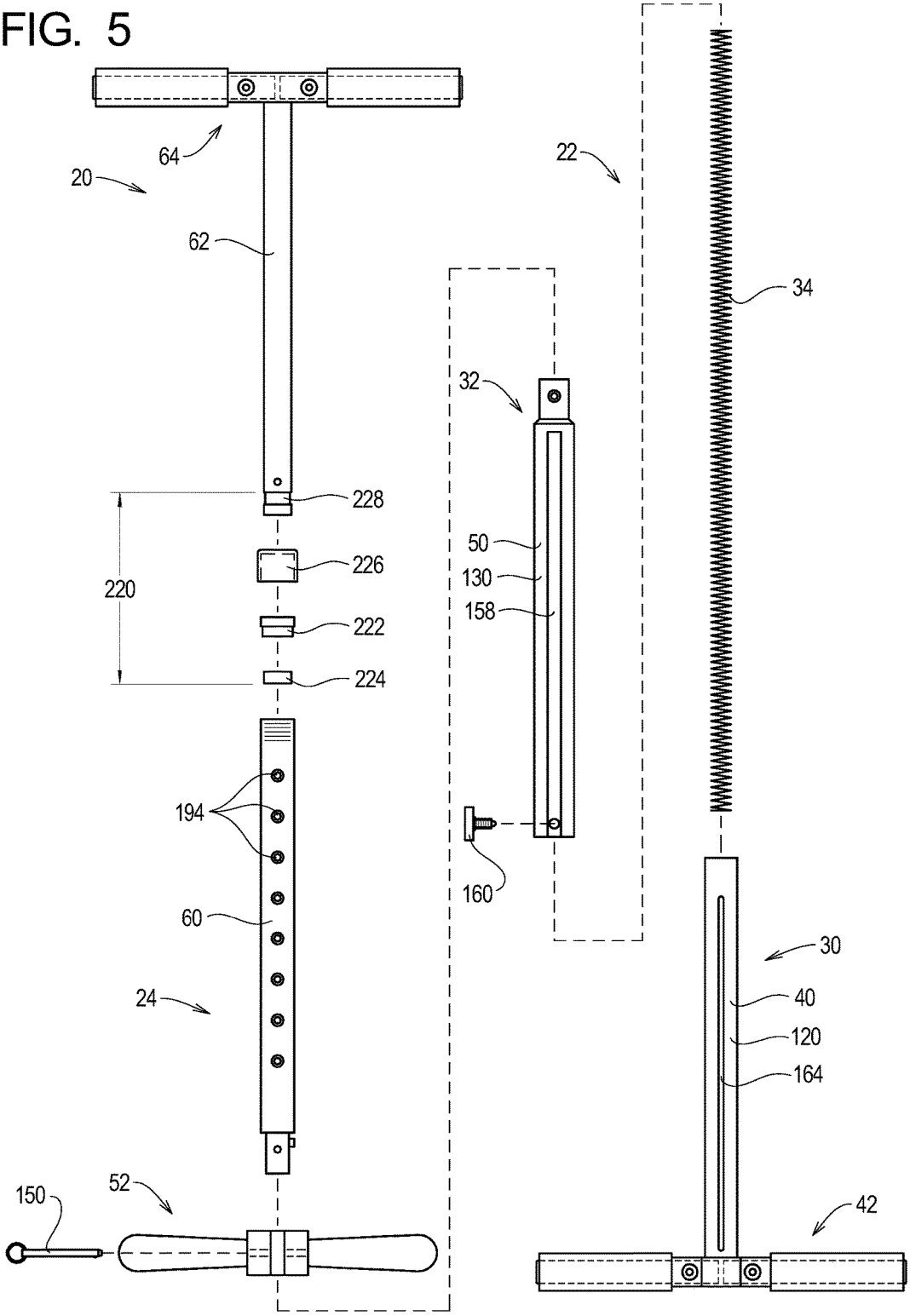
FIG. 5 is an exploded view of the first example exercise device.

Turning now to FIGS. 5 and 12, an example stabilizing system 220 may be used to stabilize the alignment of the extension tube 60 and extension rod 62 along the extension axis A. The example stabilizing system 220 comprises a first stabilizer member 222, a second stabilizer member 224, an end cap 226, and a stabilizer groove 228 formed on the extension rod 62. The first stabilizer member 222 is supported on the end of the extension tube 60, and the second stabilizer member 224 is arranged partly within the stabilizer groove 228. With the extension rod 62 partly arranged within the extension tube 60, the stabilizer members 222 and 224 engage the inner surface of the extension tube 60 and the outer surface of the extension rod 62 to allow smooth movement of the extension rod 62 within the extension tube 60 without excessive play to ensure that the axis of the extension rod 62 is aligned with the extension tube 60.

FIGS. 14 and 15 illustrate that the example sleeve brace assembly 52 comprises a sleeve collar 230 that defines the first and second brace lock openings 152 and 154 and first and second handle openings 232 and 234. First and second handles 236 and 238 are detachably attached to the sleeve collar 230 to allow the sleeve brace assembly 52 to be disassembled for storage. The example handles 236 and 238 are threaded into the first and second handle openings 232 and 234, but other means of detachably attaching the handles 236 and 238 to the sleeve collar 230 may be used.

FIGS. 16-20 illustrate an example brace structure 240 that may be used to form either or both of the support brace assembly 42 and the extension brace assembly 64. The example brace structure 240 comprises a handle base 242, first and second handle assemblies 244 and 246, and a resilient connector 248. The handle base 242 is rigidly connected to the distal end of the support tube 40/extension rod 62. The example handle base 242 is a hollow tube defining first and second end openings 250 and 252 and first and second tube detent openings 254 and 256. The example handle assemblies 244 and 246 each comprise a handle tube 260, a grip member 262, a detent member 264, and an end cap 266. The example handle tube 260 defines a handle detent opening 270. The example detent member 264 defines a detent projection 272 and a resilient portion 274 and is arranged within the handle tube 260 such that the detent projection 272 extends through the detent opening 270. The example end cap 266 is supported at a distal end of the handle tube 260. The resilient connector 248 is connected between the end caps 266 of the first and second handle assemblies 244 and 246 and extends through the handle tubes 260 and the handle base 242.

In a use configuration, the proximal ends of the handle tubes 260 are inserted into first and second end openings 250 and 252 of the handle base 242 such that the detent projections 272 extend through the first and second detent openings 254 and 256 in the handle base 242. To disconnect the handle assemblies 244 and 246 from the handle base 242 to place the example brace structure 240 in a storage configuration, the detent projections 272 are depressed against the biasing force of the resilient portions 274 such that the detent projections are substantially withdrawn from the first and second detent openings 254 and 256. The handle tubes 260 are then removed from the handle base 242. The resilient connector 248 allows the handle tubes to be removed from the handle base 242 but ensures that the handle assemblies 244 and 246 are kept with the handle base 242.

FIGS. 23-27 illustrate optional brace pads 280 that may be provided to cushion the support brace assembly 42 and/or the extension brace assembly 64. The brace pads 280 comprise a base layer 282, a cushion layer 284, and first and second snap assemblies 286 and 288. The example base layer 282 is configured to wrap around the support brace assembly 42 and the extension brace assembly 64, accommodating the support tube 40 and extension rod 62 as necessary. The cushion layer 284 is secured to the base layer 282 to provide a more comfortable engagement of the user with the support brace assembly 42 and/or the extension brace assembly 64. The example snap assemblies 286 and 288 are secured to the base layer 282 to allow the base layer 282 to be secured in place around the support brace assembly 42 and/or the extension brace assembly 64 with the cushion layer 284 in its proper position for cushioning.

What is claimed is:

1. An exercise system comprising:

an extension section comprising a first extension member, a second extension member, and an extension brace assembly, where the second extension member is rigidly supported at one of a plurality of positions relative to the first extension member along an extension axis; and the second extension member supports the extension brace assembly; and a base section comprising a support assembly comprising a support brace assembly, a sleeve assembly comprising a sleeve member, a sleeve brace assembly, and a connector system, where the connector system supports the sleeve brace assembly at any one of a plurality of locations on the sleeve member along a support axis, and a resilient member; wherein the resilient member is arranged to resiliently oppose movement of the sleeve assembly in a compression direction relative to the support assembly;

the extension section is detachably attachable to the sleeve assembly;

in a first configuration, the extension section is detached from the sleeve assembly and the sleeve brace assembly is fixed at a desired one of plurality of locations on the sleeve member; and forcing the sleeve brace assembly towards the support brace assembly displaces the sleeve assembly relative to the support assembly in the compression direction along a system axis against opposition by the resilient member;

in a second configuration, the extension section is detachably attached to the sleeve assembly such that the extension section is rigidly connected to the sleeve assembly such that the extension axis is aligned with the support axis; and forcing the extension brace assembly towards the support brace assembly displaces the extension section relative to the support assembly along the system axis in the compression direction against opposition by the resilient member.

* * * * *